United States Patent [19]

Castanis

[11] 4,019,743

[45] Apr. 26, 1977

[54] EDIFICE FOR PLAYING WORD GAME

[76] Inventor: George Castanis, 444 6th Ave., New York, N.Y. 10011

[22] Filed: Feb. 26, 1976

[21] Appl. No.: 661,772

[52] U.S. Cl. ..... 273/135 D; 273/130 AC; 273/136 E

[51] Int. Cl.[2] ..... A63F 3/00

[58] Field of Search ..... 273/130 AC, 130 B, 130 E, 273/131 AC, 135 B, 135 D, 136 E, 136 W, 131 G, 134 AB

[56] References Cited

UNITED STATES PATENTS

| | | | |
|---|---|---|---|
| 1,512,147 | 10/1924 | Tegtmeyer et al. | 273/135 D |
| 1,591,639 | 7/1926 | McDonald | 273/131 G |
| 1,655,380 | 1/1928 | Parker | 273/135 B |
| 1,714,127 | 5/1929 | Graham | 273/136 E |
| 2,335,099 | 11/1943 | Barkin | 273/130 E |
| 3,464,701 | 9/1969 | Mahoney | 273/131 AC |
| 3,806,124 | 4/1974 | Ippen et al. | 273/130 AC |
| 3,819,184 | 6/1974 | McPhail et al. | 273/136 E |
| 3,930,651 | 1/1976 | Rader | 273/130 AC |

FOREIGN PATENTS OR APPLICATIONS

| | | | |
|---|---|---|---|
| 1,811,687 | 6/1970 | Germany | 273/131 AC |
| 1,109,204 | 4/1968 | United Kingdom | 273/130 B |
| 797,013 | 6/1958 | United Kingdom | 273/130 AC |

OTHER PUBLICATIONS

Playthings Catalog; p. 4; Jan. 1956.

*Primary Examiner*—Richard C. Pinkham
*Assistant Examiner*—Harry G. Strappello

[57] ABSTRACT

A multi-level edifice for playing a three-dimensional word game whose object is to gain the highest score in forming words having a fixed number of letters with the highest point value. The edifice is constituted by a set of transparent platforms equal in number to the fixed number and supported one above the other by corner posts. Each platform is provided with a uniform array of playing sites equal in number to the square of the fixed number, some sites being "free," the others being adapted to accept playing chips bearing different letters associated with numerals representing different point values. Words are formed in a straight line on any platform level or levels on the playing edifice.

7 Claims, 11 Drawing Figures

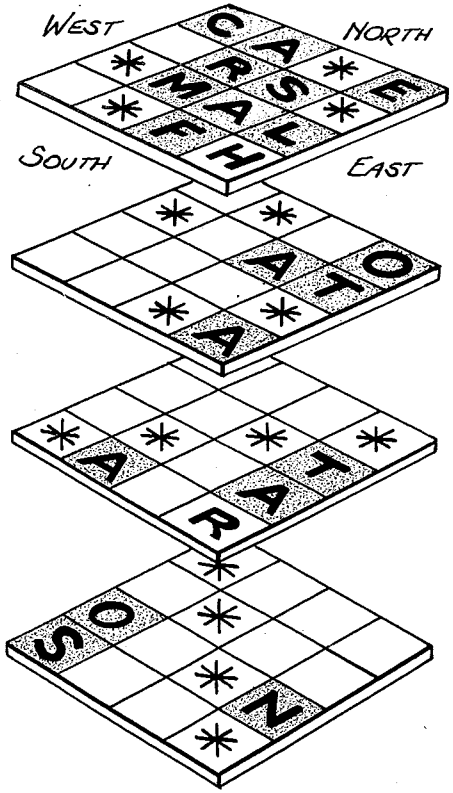
Fig. 9.
| | | | |
|---|---|---|---|
| $C_4$ | $A_1$ | | $E_1$ |
| | | $S_1$ | * |
| * | | $A_1$ | $L_2$ |
| | * | $F_5$ | |
Fig. 8A.
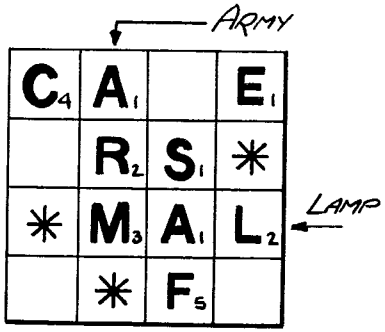
Fig. 8B.
W * L L
A
R
D
Fig. 7.
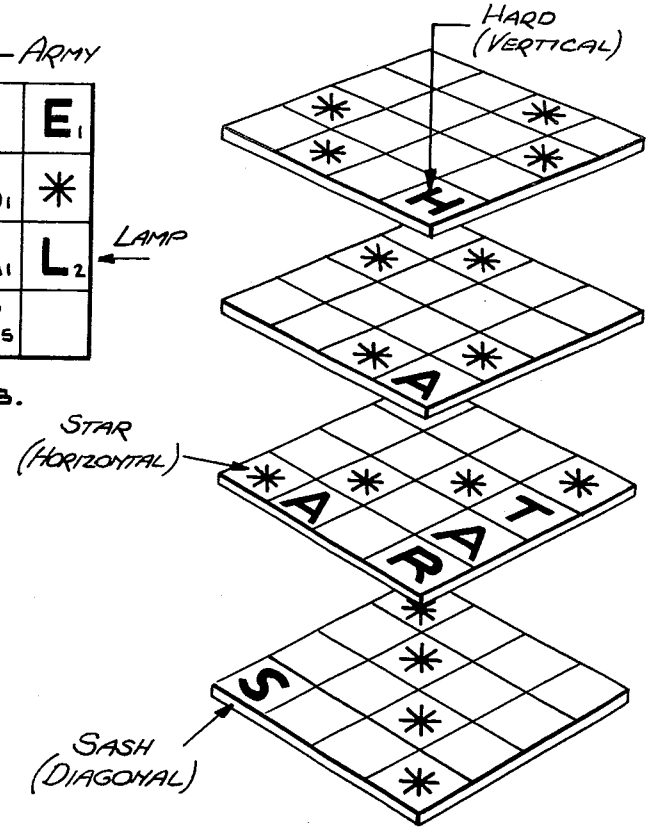
Fig. 10.
| HORIZONTALLY | | VERTICALLY | | DIAGONALLY | |
|---|---|---|---|---|---|
| LEFT TO RIGHT | RIGHT TO LEFT | TOP TO BOTTOM | BOTTOM TO TOP | TOP TO BOTTOM | BOTTOM TO TOP |
| WILL | LLIW | W I L L | L L I W | W I L L | L L I W |
| | | | | L L I W | L L I W |
USING THE WORD WILL AS AN EXAMPLE
Fig. 6.

EDIFICE FOR PLAYING WORD GAME

BACKGROUND OF INVENTION

This invention relates generally to structures for playing games, and more particularly to an edifice having multi-level transparent platforms for playing a competitive three-dimensional word game.

Basic to primary school education is the acquisition of certain skills such as word formation, spelling and arithmetic. The usual schooling procedure involves rote learning and repetitive drill. It is generally recognized that many children are unresponsive to traditional learning techniques. Because they are bored and restless, such children go through the elementary school years without acquiring more than a superficial knowledge of fundamental subject matter.

Also well known is the fact that the learning process is fostered when the interest of the student is aroused, and that in the early years this is best accomplished by play and competitive games. Thus a child who is inattentive when simple arithmetic is being taught, will become engrossed if his skill with numbers is pitted against a fellow student in a contest or game. Similarly, spelling bees serve to create excitement which stimulate students and improve their performance.

Word games are known which involve scoring, and therefore entail some exercise of arithmetic ability as well as spelling and word formation. Thus in the game of "Scrabble," interlocking words in crossword fashion are formed on a playing board using letter tiles with various point values. Each player competes for a high score by using his letters in combinations and locations that best exploit the letter values and premium squares on the board.

However, "Scrabble" and games of a similar character are for too difficult for children in the 7 to 10-year-old range. Moreover, they are essentially of a two-dimensional nature and the players do not acquire skills in sensing spatial relationships.

SUMMARY OF INVENTION

In view of the foregoing, the main object of this invention is to provide an edifice for playing a three-dimensional word game in which the highest score is gained by forming words having a fixed number of letters with the highest point value. In attaining a high score, bonuses may be earned by completing more than one word per turn.

A competitive game in accordance with the invention is stimulating to the players and serves to improve their skills in spelling, word formation and arithmetic. Also, because in playing the game one is required to visualize the formation of words in a third dimension, the game enhances the players' facility to cope with data presented in depth as well as in a planar formation.

While the invention will be described in a structural configuration adapted for a four-letter word game, it is to be understood that edifices or units adapted for five, six or other fixed-number word formations lie within the purview of the invention which lends itself to play at any age level. In the case of very young children, say, in the four- to five-year-old bracket, who are first learning to cope with letters and numbers, a three-letter word game may be appropriate.

However, the choice of a four-letter word game has a dual advantage, for the while handling four-letter word formations presents little difficulty for young players and even less difficulty for older participants, the spectrum of four-letter dictionary words is enormous. Thus a four-letter word game makes available to the player such recondite dictionary words as "ilka," "coot," "rhea" and "tarn" so that the game has virtually inexhaustible possibilities and is intriguing even to the most sophisticated player.

More specifically, it is an object of this invention to provide a multi-level three-dimensional word game structure in which each level is established by a transparent platform, the several platforms being supported in superposed relation by removabls corner posts whereby the structure may be readily assembled and thereafter dismantled and stored when not in use.

Still another object of this invention is to provide a four-letter word game which may be mass-produced at low cost.

Briefly stated, these objects are attained in a competitive three-dimensional word game in accordance with the invention in which words are formed having a fixed number of letters having different score values, use being made of an edifice constituted by a set of trasparent rectangular platforms equal in number to the fixed number, the platforms being supported one above the other by corner posts. Each post is provided with a series of sockets adapted to receive wedge-shaped nose projecting from the corners of the platforms whereby the edifice may be readily assembled or dismantled.

Formed on each platform is a uniform array of playing sites equal in number to the square of the fixed number, some sites being "free" and the others being adapted to accept playing chips having various letters of the alphabet associated with numerals representing different point values. The sites on the platform arrays lie in vertical registration whereby words may be formed in a straight line on any one platform level or on the several levels in a manner whereby an acceptable word is established by reading from left or right along the X or Y axis of a given level, or along any diagonal across, up or down or through the multi-level edifice.

OUTLINE OF DRAWING

For a better understanding of the invention as well as other objects and further features thereof, reference is made to the following detailed description to be read in conjunction with the accompanyig drawings, wherein.

Figures 4, 5:
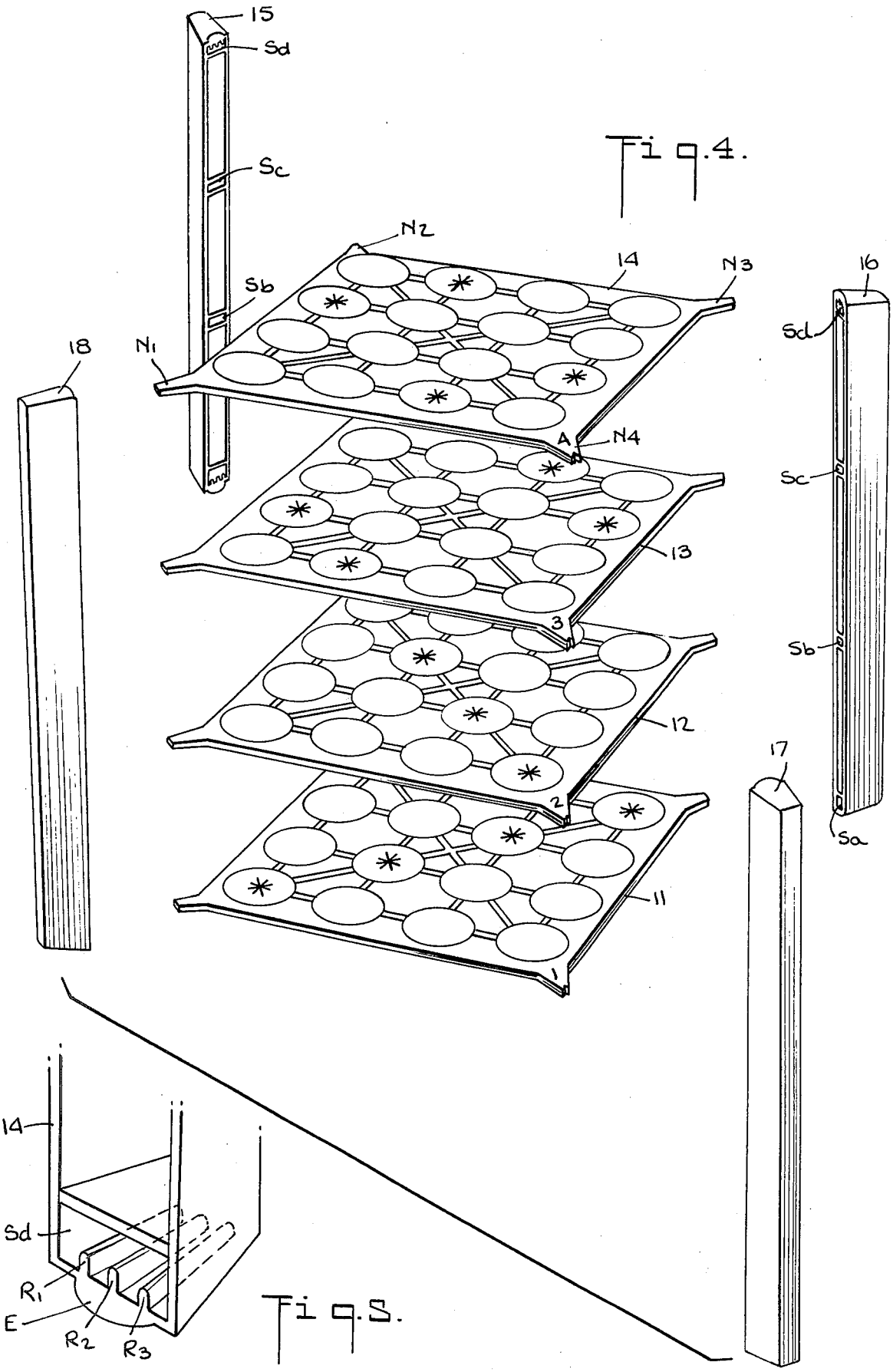
FIG. 4 is an exploded view of the edifice.

FIG. 5 separately shows, in perspective, one of the post sockets;

FIG. 6 illustrates the various possibilities for forming the four-letter word WILL;

FIG. 7 illustrates the functions of a free site;

FIGS. 8A and 8B illustrates a bonus play;

FIG. 9 illustrates a word going diagonally through the edifice; and

FIG. 10 shows how a triple bonus may be scored.

DESCRIPTION OF INVENTION

The Assembly

Figure 1:
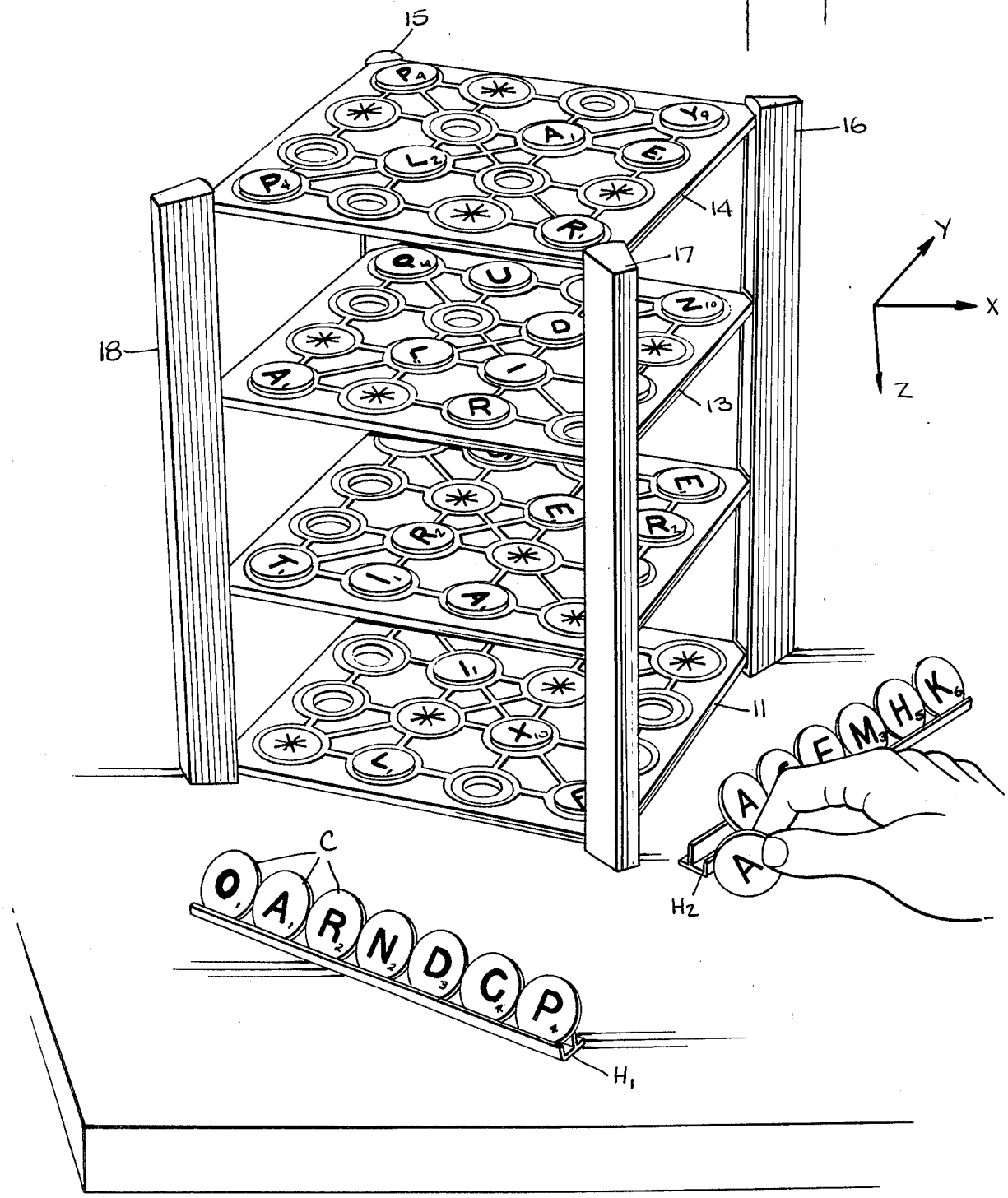
FIG. 1 is a perspective view of an erected edifice in an assembly for playing a four-letter word game in accordance with a preferred embodiment of the invention.

Referring now to FIG. 1, there is shown an assembly for playing four-letter word games in accordance with the invention, the assembly including a multi-level edifice, generally designated by numeral 10. The assembly also includes a bank of 100 playing chips C, each chip having on its face an alphabet letter associated with a numeral representing a scoring point. These chips are supported in viewing position by channel-shapped holders H capable of supporting seven chips. Four such holders $H_1$ to $H_4$ are provided so that a maximum of four players may participate in the game. The game may also be played by two or three players. In FIG. 1, only holders $H_1$ and $H_2$ are shown.

It will be seen that in holder $H_1$ there are seven chips with different letters having various point values ($O_1$, $A_1$, $R_2$, $N_2$, $D_3$, $C_4$ and $P_4$). The bank of 100 chips provided with the game encompasses all or most of the letters of the alphabet, but the distribution of letters is such as to take into account their normal frequency of use in the spectrum of possible four-letter words. Thus out of the 100 chips, eight may bear the letter E, and ten the letter A, while only one Q is provided, since a fairly limited number of four-letter words include this letter.

Figure 2:
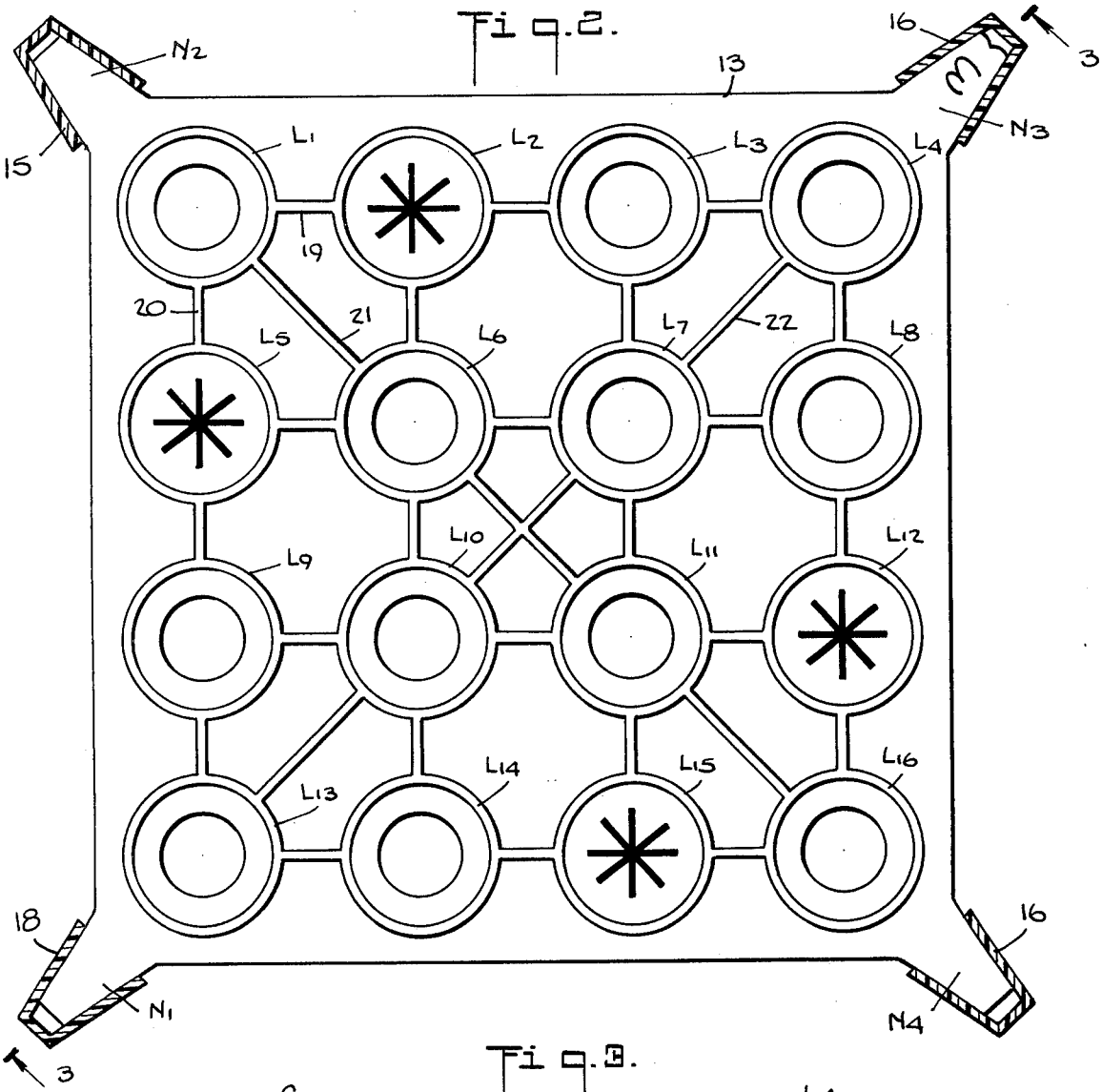
FIG. 2 is a plan view of one of the platforms of the edifice.
Figure 3:
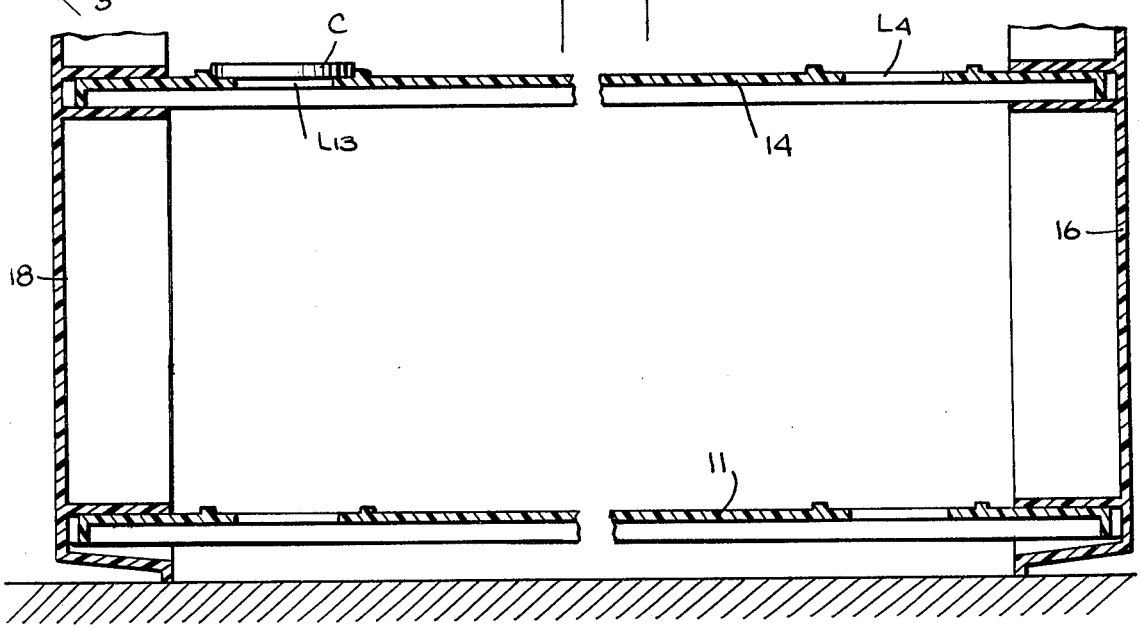
FIG. 3 is a vertical section taken in the plane indicated by line 3—3 in FIG. 2.

Edifice 10 is created by means of four rectangular platforms 11, 12, 13 and 14 molded of rigid transparent plastic material. The platforms are supported one above the other by four hollow corner posts 15, 16, 17 and 18. Each platform, as best seen in FIGS. 2, 3, and 4 is provided at its four corners with projecting noses $N_1$ to $N_4$, which are wedge-shaped. These noses are received in trapezoidally-shaped sockets $S_a$, $S_b$, $S_c$ and $S_d$ formed at different heights in the posts, socket $S_a$ being at the bottom, socket $S_d$ being at the top, and sockets $S_b$ and $S_c$ being at intermediate positions on the posts. THe sockets are equi-spaced so that the platform levels have like spacings.

The top wall of the uppermost socket $S_d$ and the bottom wall of the lowermost socket $S_a$ is in a ribbed formation, as shown by ribs $R_1$, $R_2$ and $R_3$ in FIG. 5, these ribs serving to provide a frictional fit, preventing disengagement of the noses from the sockets.

Since the four platforms have different "free" sites, as will later be explained, it is necessary that they be set up in the proper order. For this purpose, each platform is individually numbered at its northeast nose $N_3$, as indicated by number 3 in FIG. 3. This serves to so distribute the "free" sites which are indicated by stars whereby any word formed will have no more than one free space.

In assembling the edifice, one starts by inserting the nose numbered 1 of the lowermost platform 11 in the bottom socket $S_a$ of one post, the nose being pressed firmly in so that it locks securely. Then the numbered nose of the platform 12 is inserted in socket $S_b$ of the same post directly above the first platform, this procedure being followed for platforms 13 and 14. A second post directly opposite the one already assembled is then added, after which the remaining posts are installed. It will be seen in FIG. 5 that the ends of the posts, such as the bottomm end E of post 14, are rounded, thereby making it possible to rotate the edifice on a hard surface for easier viewing.

Formed on each platform, as best seen in FIG. 2, is a uniform array of circular playing sites $L_1$ to $L_{16}$ equal in number to the square of the predetermined number of letters which made up an acceptable word. Thus in a four-letter word game, the square of 4 is 16. Should the fixed number be 5 in a five-letter word game, then the array would be formed by five rows, each having five sites. All of the sites in the several platform levels lie in vertical registration.

In FIG. 2, sites $L_2$, $L_5$, $L_{12}$ and $L_{15}$ are formed with raised discs bearing a star to indicate that these sites are "free" or "wild," whereas the remaining sites have circular depressions or wells adapted to accommodate playing chips inserted therein, as shown in FIG. 1. The wells are provided with finger holes to facilitate removal of the chips therefrom.

The sites in the array are joined by molded lines 19 and 20 in the X or Y axis directions, respectively, and lines 21 and 22 which run through the diagonals of the array, these lines indicating the straight line directions in which four-letter words may be formed in the plane of the platform level.

PLAYING THE GAME

At the outset, all of the letter chips C are placed face-down in a suitable box, with the letters hidden. This box may be the box in which the game is packaged. The players draw one letter chip, the letter closest to "A" starting the game. All players (2, 3 or 4 players) each draw seven chips and stand them in their respective chip holder H.

The first player then proceeds to form one four-letter word in a straight line on any platform level or levels on the playing edifice, so that the play is carried out in three dimensions. A word may be formed reading from left to right along the X or Y axis of a given level, or up or down (Z direction) though the four levels, or along a diagonal across a given level or through the four-level playing edifice.

Thus, as shown in FIG. 3, using the word WILL as an example, WILL may be formed horizontally left to right or in reverse order. Alternatively, WILL may be formed vertically from top to bottom or in reverse order, or diagonally along either diagonal line from top to bottomm or in the reverse order.

The first player will use a set of four letter chips if no star or free site is used, or only three chips if a star is used. To score a word, the player adds up the numbers associated with the chips forming the four-letter word. After the score for a play is recorded, the player draws as many new letter chips from the bank as have been played, thereby always maintaining seven letters in the holder, as shown in FIG. 1.

The play then passes to the left. The second player creates a four-letter word anywhere on the edifice. New words need not cross-connect with existing words. As the playing edifice becomes increasingly filled with chips, fewer chips may be required to complete a word, and sometimes a single chip will suffice for this purpose.

Sites decorated with stars are "wild" and can therefore stand for any letter elected by the player. These stars are never covered by chips and have no scoring value. Moreover, a star may represent a particular letter in a word going in one direction and a different letter in a word going in another direction.

This principle is illustrated in FIG. 7 where the star in the horizontal set of letters can be made to represent A or E or I, forming the words WALL, WELL or WILL (only one word is scored). In the vertical letter set, the star can represent a Y, C or B, etc., thereby forming the words YARD, CARD, BARD or DRAB. It is to be noted, in this instance, that DRAB is BARD in reverse (only one word is scored).

Only words found in a standard dictionary acceptable to all players are legal. Plurals are allowed in the game, but proper names, foreign words, abbreviations and contractions are not.

Any player may challenge the legality of a word just after it has been played, legality being determined by reference to the dictionary. If the word is deemed to be illegal, the player forming the word is required to take back the played chips and he loses the turn.

At the start of a turn, any player may exchange all the letters in his holder by drawing seven new letter chips from the bank. But when he chooses to make this exchange, the player loses this turn to play. Play continues until all spaces on all levels of the edifice have been filled, or until no player in rotation can make up a four-letter word. At the conclusion of the game, the players add their scores and the player with the highest total is acclaimed the winner.

A double bonus is earned if a player, in creating a new word, also uses the same letter to complete a second new word. To score, one merely doubles the points scored for each word. Thus FIG. 8A shows a platform level before a player adds new letter chips thereto. FIG. 8B shows the same level after the letters R and M have been added, making up the word ARMY. In creating ARMY, a second word LAMP also happens to be completed, the word LAMP reading backwards from left to right.

The scoring for this play is as follows:

| | | |
|---|---|---|
| $A_1 + R_2 + M_3 + *$ | = | 6 points |
| $L_2 + A_1 + M_3 + *$ | = | 6 points |
| Total Score | | $12 \times 2 = 24$ points |

A triple bonus is earned if, upon making a new word, the chip letters also complete two other words. The shaded areas in FIG. 9 show the playing sites before new chips were added. The newly-added letters H&R lie in a vertical line in the southeast corners of the levels. An example of a word going diagonally through the four levels is the word EATS, which starts with E at the northeast corner and goes diagonally down to S in the southwest corner. It will be noted that letter H on the top level also completes four-letter combinations on this level that are not words and therefore have no point value.

FIG. 10 shows the letters H & R forming the new word HARD. Two other new words (SASH and STAR) were also completed, so a triple bonus is earned, as shown by the following scoring:

| | | |
|---|---|---|
| $H_5 + A_1 + R_2 + *$ | = | 8 points |
| $S_1 + A_1 + * + H_5$ | = | 7 points |
| $* + T_1 + A_1 + R_2$ | = | 4 points |
| Total Score: | | $19 \times 3 = 57$ points |

When four new words are completed, the score is four times the total, and when five new words are completed, one scores five times the total, and so on. The player should therefore always check for a bonus move before placing his chips. The easiest way to locate a bonus opportunity is to find a word needing only one letter and then fill in a crossword in another direction.

While there has been shown and described a preferred embodiment of an assembly formed by an edifice, playing chips and holders therefor, for playing a word game in accordance with the invention, it will be appreciated that many changes and modifications may be made therein without, however, departing from the essential spirit thereof. Thus in the edifice the wild sites may be omitted, and the rules of the game modified accordingly.

I claim:

1. An assembly for playing a three-dimensional word game in which the highest score is obtained by forming words having a fixed number of letters with the highest point value, said assembly comprising:

A a multi-level edifice having a plurality of transparent platforms supported in superposed relation more or less above ground to provide playing levels equal in number to the fixed number, each level having formed thereon a rectangular array of equispaced circular playing sites equal in number to the squares of the fixed number, corresponding sites on the several levels being in vertical registration, the majority of the sites having circular wells therein provided with finger holes, said circular sites being interconnected by straight lines in the X, Y and diagonal directions to indicate the straight line directions in which words may be formed on each level, the remainder of said sites being integrally provided with permanent discs carrying stars to indicate "wild" spaces; and B a bank of disc-shaped playing chips, each having a letter thereon associated with a numeral representing a point value, said chips having a diameter slightly smaller than that of said wells and being receivable therein to create words having said fixed number of letters in a straight line in the X, Y and diagonal directions across any level, and in the Z and diagonal directions passing through said levels, whereby words may be formed in three dimensions, said chips being removable from said wells by inserting a finger in said finger holes.

2. An assembly as set forth in claim 1, further including channel-shaped holders for supporting said chips in a viewable position.

3. An assembly as set forth in claim 1, wherein said platforms are rectangular and are supported by corner posts.

4. An assembly as set forth in claim 3, wherein each platform is provided at its corners with wedge-shaped projecting noses which are received in trapezoidally-shaped sockets formed in said corner posts.

5. An assembly as set forth in claim 4, wherein the ends of said corner posts are rounded to permit rotation of the edifice to facilitate viewing.

6. An assembly as set forth in claim 1, wherein said fixed number is four.

7. An assembly as set forth in claim 4, wherein said corner posts are hollow and said sockets are defined by a pair of parallel walls transverse to the vertical walls of the posts.

* * * * *

UNITED STATES PATENT AND TRADEMARK OFFICE

CERTIFICATE OF CORRECTION

PATENT NO. : 4,019,743

DATED : April 26, 1977

INVENTOR(S) : George Castanis

It is certified that error appears in the above-identified patent and that said Letters Patent are hereby corrected as shown below:

Column 1, line 67 "the" should be deleted

Column 2, line 14 "removabls" should have read -- removable -- line 24 "traspar-" should have read -- transpar-. -- line 28 "nose" should have read -- noses --

Column 3, line 11 "shapped" should have read -- shaped -- line 40 "THe" should have read -- The -- line 65 "bottomm" should have read -- bottom --

Column 4, line 37 "though" should have read -- through -- line 45 "bottomm" should have read -- bottom --

Signed and Sealed this ninth Day of August 1977

[SEAL]

Attest:

RUTH C. MASON
*Attesting Officer*

C. MARSHALL DANN
*Commissioner of Patents and Trademarks*